US009186768B2

(12) United States Patent
Warner et al.

(10) Patent No.: US 9,186,768 B2
(45) Date of Patent: Nov. 17, 2015

(54) AIRCRAFT SKIN SURFACE PLANING

(71) Applicant: Lockheed Martin Corporation, Bethesda, MD (US)

(72) Inventors: Sean Benjamin Warner, Saginaw, TX (US); Michael L. Hestness, Fort Worth, TX (US); Richard A. Luepke, Fort Worth, TX (US)

(73) Assignee: lockheed Martin Corporation, Bethesda, MD (US)

( * ) Notice: Subject to any disclaimer, the term of this patent is extended or adjusted under 35 U.S.C. 154(b) by 108 days.

(21) Appl. No.: 13/826,933

(22) Filed: Mar. 14, 2013

(65) Prior Publication Data

US 2014/0273755 A1 Sep. 18, 2014

(51) Int. Cl.

| | |
|---|---|
| ***B24B 23/02*** | (2006.01) |
| ***B24B 19/26*** | (2006.01) |
| ***B24B 27/033*** | (2006.01) |
| ***B24B 19/00*** | (2006.01) |

(52) U.S. Cl.

CPC ..... *B24B 19/005* (2013.01); *B24B 19/26* (2013.01); *B24B 23/02* (2013.01); *B24B 27/033* (2013.01)

(58) Field of Classification Search

CPC ..... B24B 23/00; B24B 23/02; B24B 19/26; B24B 27/033

USPC ..... 451/358, 354, 352, 344, 28

See application file for complete search history.

(56) References Cited

U.S. PATENT DOCUMENTS

| | | | | |
|---|---|---|---|---|
| 851,702 | A * | 4/1907 | Spietschka | 30/476 |
| 915,080 | A * | 3/1909 | Dixson et al. | 30/477 |
| 1,540,591 | A * | 6/1925 | Barker | 451/358 |
| 2,136,529 | A * | 11/1938 | Trimble | 451/65 |
| 2,166,861 | A | 7/1939 | Draheim | |
| 2,277,236 | A | 3/1942 | Kneisley et al. | |
| 2,472,161 | A * | 6/1949 | Godfried | 451/352 |
| 2,625,860 | A | 1/1953 | Plester | |
| 2,987,970 | A * | 6/1961 | Watson | 409/181 |
| 3,421,411 | A * | 1/1969 | Lowry et al. | 409/143 |
| 3,456,555 | A | 7/1969 | Dunlap | |
| 3,705,448 | A | 12/1972 | Bansen | |
| 5,105,585 | A | 4/1992 | Hampl et al. | |
| 6,645,048 | B1 * | 11/2003 | Linderholm et al. | 451/28 |
| 6,929,436 | B2 * | 8/2005 | Shannon | 409/178 |
| 2003/0002946 | A1 | 1/2003 | Hsieh | |

FOREIGN PATENT DOCUMENTS

| | | |
|---|---|---|
| DE | 3831854 A1 | 4/1989 |
| DE | 9103187 U1 | 6/1991 |
| WO | 2012045912 A1 | 4/2012 |

OTHER PUBLICATIONS

European Search Report dated Oct. 24, 2014 for Application No. 14160094.0; Applicant: Lockheed Martin Corporation; 12 pages.

Partial European Search Report for Application No. 14160094.0-1709, dated Jul. 3, 2014; 8 pages.

* cited by examiner

*Primary Examiner* — Robert Rose

(74) *Attorney, Agent, or Firm* — Reising Ethington P.C.

(57) ABSTRACT

A contoured surface planing apparatus for removing proud-standing material from a contoured surface without damaging the surface. The apparatus may include a tool comprising a motor-driven rotary cutter supported by a main body for rotation about a cutter axis, and orientation contact points spaced around the cutter and defining an orientation contact plane disposed parallel to the cutter axis.

16 Claims, 4 Drawing Sheets

AIRCRAFT SKIN SURFACE PLANING

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND

1. Field

This application relates generally to the removal of excess material from a contoured surface, and may relate, more specifically to the removal of excess low-observable performance filler paste (LO filler) from over fastener holes in a composite aircraft skin panel.

2. Description of Related Art Including Information Disclosed Under 37 CFR 1.97 and 1.98

Low-observable performance material (LO filler) is applied as a filler paste over each of approximately 20,000 exterior fasteners on the F-35 aircraft. The application often leaves about 0.010"-0.020" of LO filler proud of the surface. To achieve desired low-observable characteristics it's desirable to remove enough of the excess LO filler so that an outer surface of remaining LO filler lies nearly flush with an outer surface of the skin panel (0.002-0.005" proud, depending on working surface contour curvature). Known methods of removing the excess LO filler include use of random orbital sanders, rough file, razor blades, and/or other manually driven hand tools. These methods have proven very time-consuming and exhausting and, when used without caution or skill, can result in damage to the composite skin surface surrounding the fasteners.

SUMMARY

A contoured surface planing apparatus is provided. The apparatus may comprise a tool including a main body, a rotary cutter supported by the main body for rotation about a cutter axis. The rotary cutter may comprise an abrasive outer circumferential cutter surface such as a routing surface. The tool may also include a motor operatively engageable with the cutter and configured to drive the cutter in rotation about the cutter axis, and at least three orientation contact points spaced around the cutter and defining an orientation contact plane disposed parallel to the cutter axis.

Also, a method is provided for removing proud-standing material from a contoured surface without damaging the surface. The method may include the steps of adjusting the distance between an orientation contact plane and a rotary abrasion contact region of a surface planing tool to a desired cutter displacement value, positioning the planing tool on a working surface with orientation contact points of the tool resting on the working surface, and reducing the height of proud-standing material by directing the tool along the working surface while maintaining the orientation contact points of the tool in contact with the working surface and while engaging the cutter with the proud-standing material.

DRAWINGS DESCRIPTIONS

These and other features and advantages will become apparent to those skilled in the art in connection with the following detailed description and drawings of one or more embodiments of the invention, in which.

DETAILED DESCRIPTION

Figure 1:
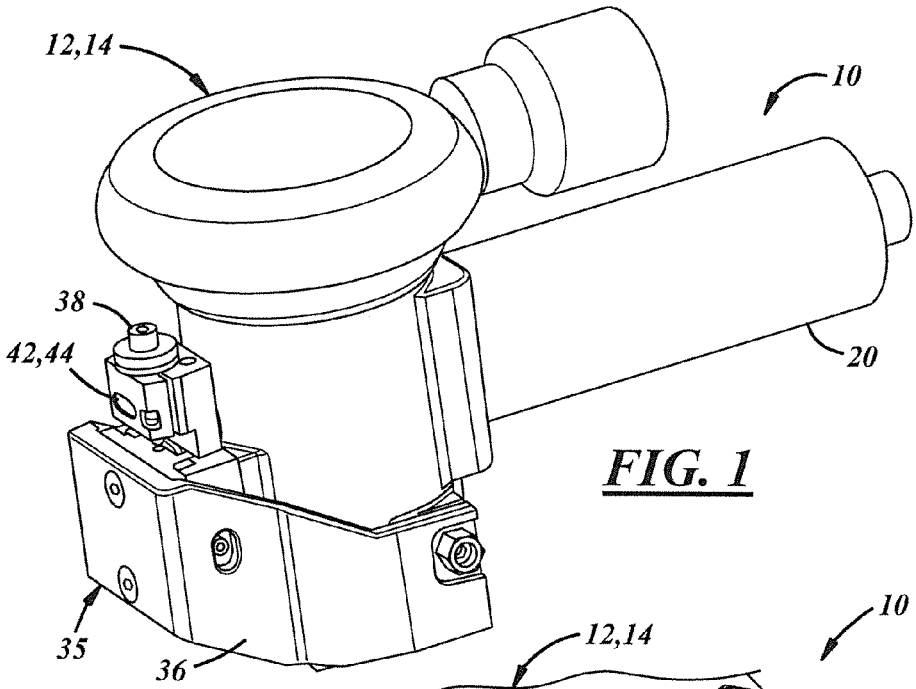
FIG. 1 is an isometric view of a contoured surface planing apparatus.
Figure 2:
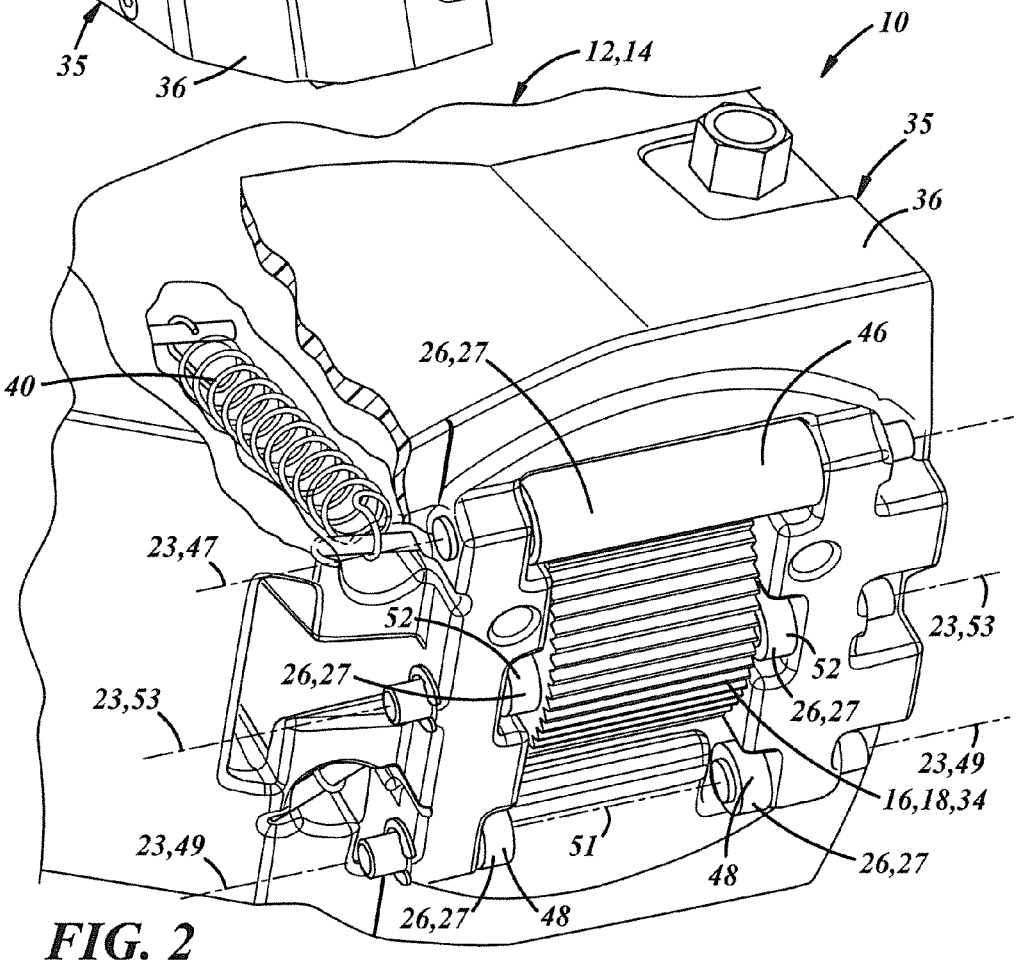
FIG. 2 is a partial cross-sectional fragmentary bottom isometric view of the apparatus of FIG. 1 cut-away to show a spring connected between and biasing a chassis of the apparatus toward a base of the apparatus.
Figure 5:
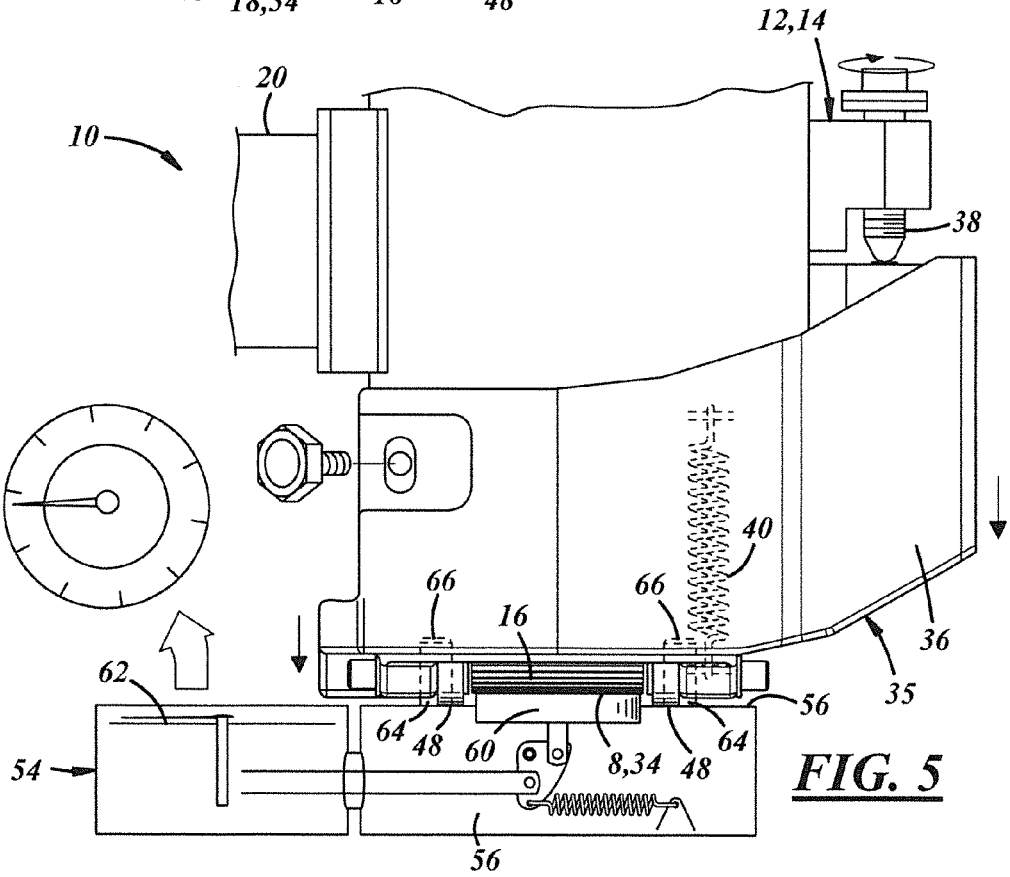
FIG. 5 is a fragmentary front view of the apparatus of FIG. 4 seated on the setup fixture of FIG. 4 with the guide pins of the setup fixture received in the guide pin receptacles of the apparatus.

A contoured surface planing apparatus for removing proud-standing material from a contoured working surface, e.g., for removing excess low-observable performance filler paste (LO filler) from over fastener holes in a composite aircraft skin panel, and doing so without damaging the working surface, is generally shown at 10 in FIGS. 1-7. As shown in FIG. 2, the apparatus 10 may comprise a tool 12 including a main body 14 and a generally cylindrical or drum-shaped rotary carbide cutter 16 supported by the main body 14 for rotation about a cutter axis 17. As best shown in FIG. 5, the cutter 16 may comprise an abrasive outer circumferential serrated cutter surface 18 such as a routing surface, which is coaxially located with respect to the cutter axis 17. As shown in FIG. 1, a drill motor 20 may be carried by the main body 14 and connected to the cutter 16. The drill motor 20 may be configured to drive the cutter 16 in rotation about the cutter axis 17.

As best shown in FIG. 2, the tool 12 may include at least three, and preferably five, rollers 46, 48, 52 supported on the base for rotation about respective roller axes 23. The roller axes 23 may be disposed parallel to the cutter axis 17 and thus normal to an intended direction of cut so that the rollers 46, 48, 52 will be positioned to provide rolling contact with a working surface 24 in the intended direction of cut. The working surface 24 may be that of a workpiece 25 such as, for example, a composite F-35 skin panel.

Figure 6:
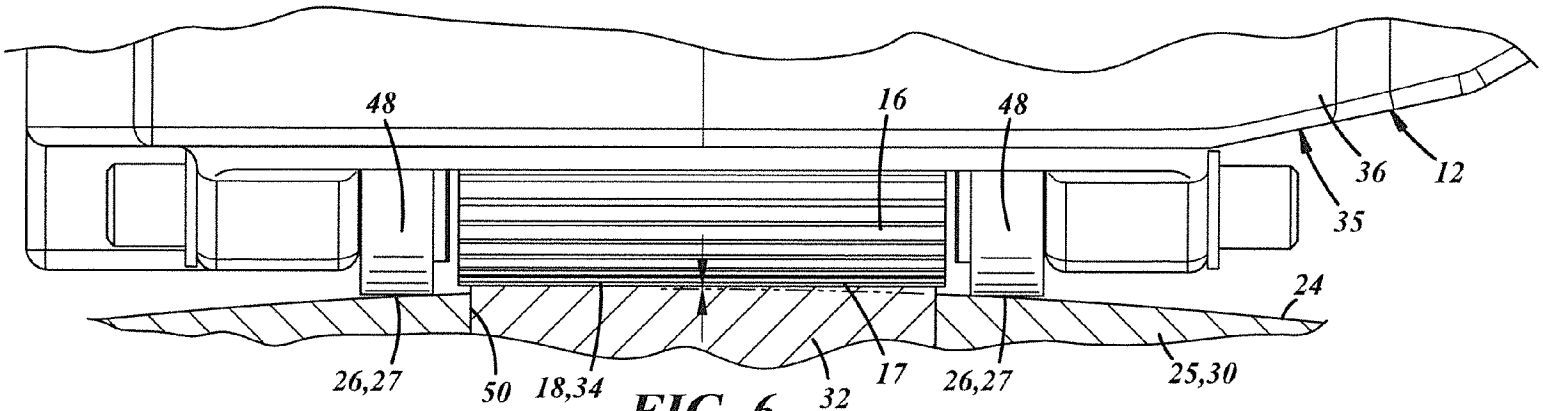
FIG. 6 is a fragmentary front view of the apparatus of FIG. 1 showing rollers of the apparatus resting on an aircraft skin panel astride a fastener hole over-filled with LO filler, and with a rotary cutter of the apparatus shown engaging the LO filler.

The apparatus 10 may include orientation contact points 26 spaced around the cutter 16. The orientation contact points 26 may define an orientation contact plane 28 (shown in FIG. 3) disposed parallel to the cutter axis 17 so that orientation of the tool 12 with all orientation contact points 26 contacting a working surface 24, as shown in FIGS. 6 and 7, will also orient the rotational axis 17 of the cutter 16 parallel to a portion of the working surface 24 to be planed.

Figure 7:
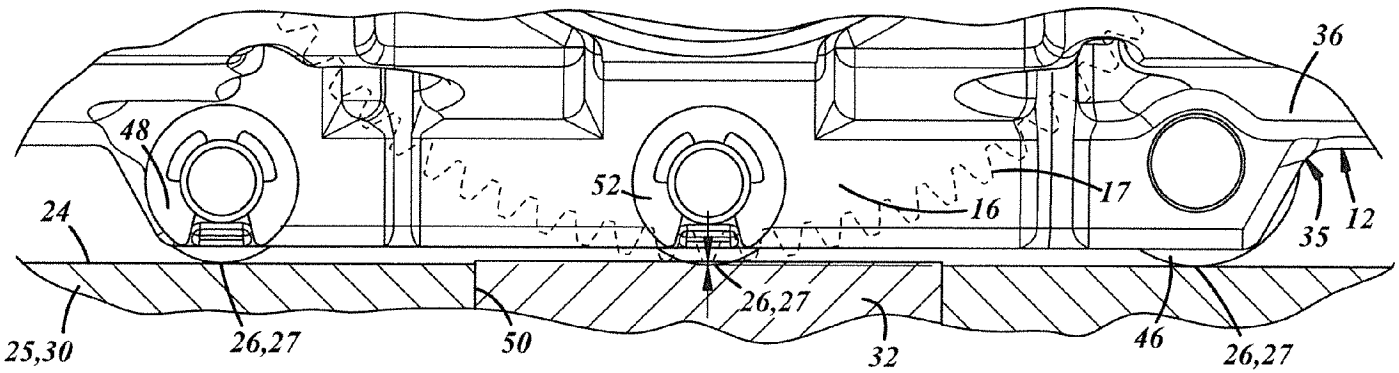
FIG. 7 is a fragmentary side view of the apparatus, aircraft skin panel, and over-filled fastener hole of FIG. 6.

As shown in FIG. 7, the contact points 26 may be respective rolling contact points 27 of the rollers 46, 48, 52, (defined as the points where the rollers 46, 48, 52 contact the working surface 24 during a planing operation,) and the orientation contact plane 28 may thus be a rolling contact plane 29, (i.e., a plane defined by the rolling contact points 27 of the rollers 46, 48, 52. In other words, the rolling contact point of each roller may be whatever portion of a circumferential outer rolling surface of the roller lies in the rolling contact plane,) and may be in rolling contact with a working surface 24 when the tool 12 is held in rolling contact with the working surface 24 during a planing operation. This planar roller arrangement prevents the cutter 16 from cutting too deeply and removing composite panel material 30 along with LO filler material 32 while passing over or riding along projecting contours in the working surface 24.

Figure 3:
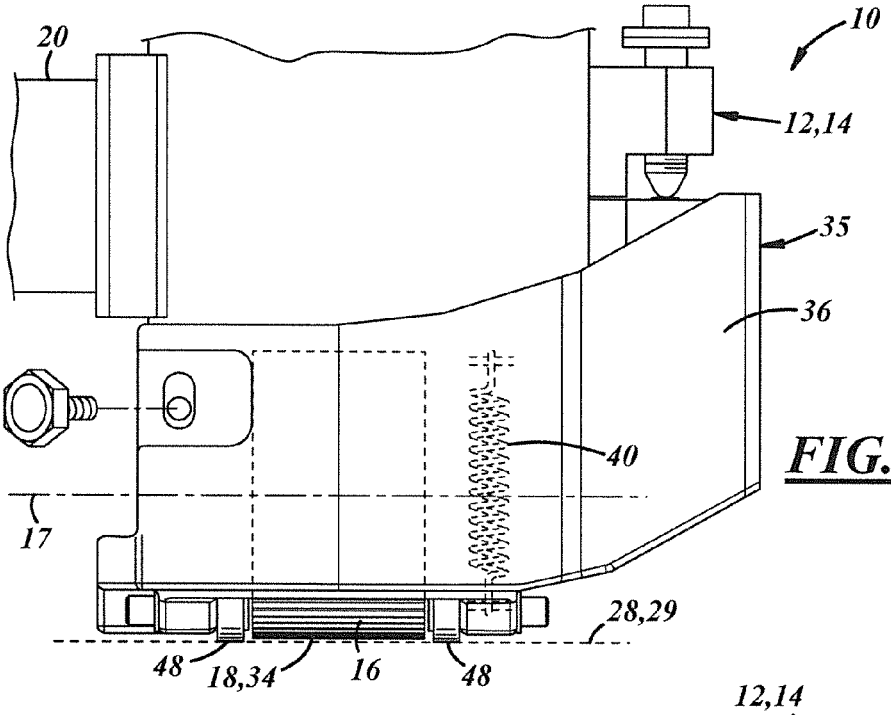
FIG. 3 is a fragmentary front view of the apparatus of FIG. 1.

As shown in FIG. 3, the rolling contact plane 29 may be spaced from, and below, a rotary abrasion contact region 34 of the rotary cutter 16. The rotary abrasion contact region 34 of the cutter 16 may be defined as whatever portion of the outer circumferential abrasive cutter surface 18 is closest to the rolling contact plane 29 at any given point in time. The rotary abrasion contact region 34 may thus be presented in a position for abrading contact with a mass of LO filler material 32 carried by and standing proud of a working surface 24. The rolling contact plane 29 may also be spaced or displaced radially from the rotary abrasion contact region 34 by a cutter displacement value sufficient to protect protruding contours of a working surface 24 from abrading contact with the cutter 16 during a planing operation. This planar roller arrangement may thus prevent the cutter 16 from cutting too deeply and removing composite panel material 30 along with the LO filler material 32 while passing over or riding along projecting contours in the working surface 24.

As shown in FIGS. 1-5, the tool 12 may include a rolling foot 35, which may comprise the rollers 46, 48, 52, and a chassis 36 carried by the main body 14, upon which the rollers 46, 48, 52 may be supported for rotation about their respective roller axes 23. The chassis 36 may be supported on the main body 14 for reciprocal motion relative to the main body 14 so that the chassis 36 may be moved between fully extended and fully retracted positions to adjust cutter displacement, (i.e., the distance between the rolling contact plane 29 and the abrading contact region 34 of the cutter 16,) allowing cutting depth to be adjusted to accommodate different working surface contour geometries.

The tool 12 may include a cutter displacement adjustment screw 38, best shown in FIG. 3, which may be threadedly engaged with the main body 14 to bear downward against the chassis 36. As best shown in FIG. 2, the tool 12 may further include a biasing element 40 supported between the chassis 36 and the main body 14 in a position to bias the chassis 36 upward against the adjustment screw 38 so that cutter displacement can be adjusted by turning the adjustment screw 38 to change the position of the chassis 36 relative to the main body 14 between the fully extended and fully retracted positions.

Figure 4:
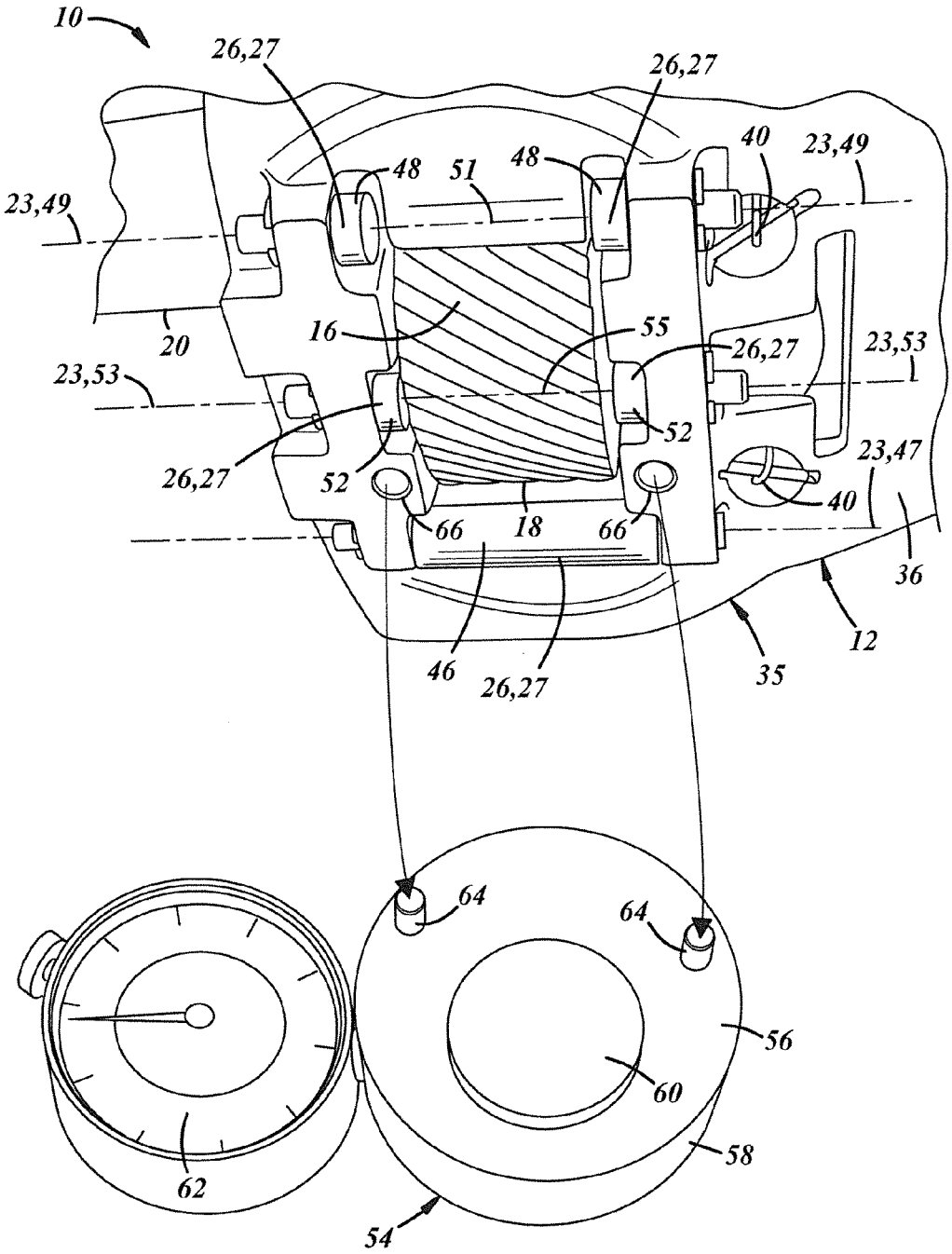
FIG. 4 is a fragmentary bottom view of the apparatus of FIG. 1 showing guide pin receptacles of the apparatus and a setup fixture having corresponding guide pins.

As shown in FIGS. 2, 4, and 7, one of the rollers may be an elongated aft roller 46 supported on the chassis 36 for rotation about a aft roller axis 47 oriented parallel to the rolling contact plane 29, parallel to the cutter axis 17, and centered on and spaced behind the cutter 16 relative to the intended direction of cut. The elongated aft roller 46 may have an axial length greater than or equal to an axial length of the outer circumferential cutter surface 18 to ensure that the cutter 16 does not cut into contours of a working surface 24 while removing excess LO filler 32. In the present embodiment, the cutter 16 and the abrading contact region 34 of the cutter 16 may have an axial length of 0.75". This should allow the tool 12 to be used on a compound curved working surface having a 30" radius one direction and a 100" radius in the other without damaging the surface. However, in other embodiments, any suitable length of aft roller 46 or cutter 16 may be used to adapt the tool 12 to work on differently-curved surfaces. In other embodiments, the aft roller 46 may comprise multiple rollers or rolling elements rather than a single roller.

Two of the rollers may be 0.25" wide leading rollers 48 supported on the chassis 36 for rotation about respective leading roller axes 49. The leading roller axes 49 may be coaxially disposed along a common leading roller axis 51 parallel to the cutter axis 17 and spaced ahead of the cutter 16 relative to the intended direction of cut. The leading rollers 48 may be centered on the cutter 16, and may be spaced axially from one another by a distance approximately equal to the axial length of the outer circumferential cutter surface 18. The leading rollers 48 may thus be spaced to bridge a region of the working surface 24 to be cut, allowing the tool 12 to be run along a row of LO paste-filled fastener holes 50 while straddling patches of excess LO filler 32 to be removed from over the holes 50.

Two of the rollers may be 0.25" wide side mid rollers 52 supported on the chassis 36 for rotation about respective mid roller axes. The mid roller axes 53 may be coaxially disposed along a common mid roller axis 55. The mid roller axes 53 may be parallel to the cutter axis 17 and disposed between the cutter axis 17 and the rotary abrasion contact region 34 of the rotary cutter 16 to ensure that the rotary abrasion contact region 34 remains spaced from the rolling contact plane 29. To reduce curvature issues the mid rollers 52 may be disposed as close as practical to the cutter 16.

As shown in FIGS. 4 and 5, the apparatus 10 may include a setup fixture 54 comprising a support surface 56 carried by a fixture base 58. The support surface 56 may be configured to support the tool 12 with the orientation contact points 26 (e.g., the rollers 46, 48, 52) of the tool 12 resting on the support surface 56. A cutter contact element 60 may also be carried by the fixture base 58, and may be biased upward relative to the support surface 56 to maintain contact with the cutter 16 during cutter displacement adjustment. A gage 62 may be connected to the cutter contact element 60 and configured to measure cutter displacement by measuring cutter contact element displacement relative to the support surface 56. The gage 62 may also be configured to show an operator a visual representation of the magnitude of cutter displacement when the tool 12 is resting on the support surface. The setup fixture 54 may be, for example, a 0.0005" graduation zero-setter gage such as is manufactured by the Mitutoyo Corporation.

As best shown in FIG. 4, the setup fixture 54 may include two parallel guide pins 64, and the tool 12 may include two parallel guide pin receptacles 66 positioned and configured to receive the guide pins 64 when the tool 12 is mounted on the setup fixture 54. The guide pins 64 and receptacles 66 may be arranged to positively position the tool 12 such that the cutter 16 rests on the cutter contact element 60 and the orientation contact points 26 (e.g., the rollers 46, 48, 52) rest on the support surface 56.

In practice, excess material, such as excess LO filler 32, may be removed from a contoured working surface, such as from over fastener holes 50 in a composite F-35 skin panel, without damaging the working surface, by first mounting the tool 12 on a support surface 56 of a setup fixture 54 such that the orientation contact points 26 of the tool rest on the support surface 56 of the fixture, the rotary cutter 16 of the tool rests on a cutter contact element 60 of the fixture 54, and such that a gage 62 connected to the cutter contact element 60 displays a numerical cutter displacement value, i.e., a value representing the distance between the rotary abrasion contact region 34 and the orientation contact plane 28 of the tool 12. Cutter displacement may then be adjusted until a desired cutter displacement value of, for example, 0.003 inches is displayed on the gage 62 by turning a cutter displacement adjustment screw 38. The planing tool 12 may then be positioned on a working surface 24 adjacent a mass of LO filler material 32 standing proud of the working surface 24 and the tool 12 oriented such that the contact points 26 of the tool rest on the working surface 24.

The height of the proud-standing LO filler material 32 may then be reduced by directing the tool 12 along the working surface 24 while maintaining the orientation contact points 26 of the tool 12 in contact with the working surface 24, and engaging the cutter 16 with the LO filler material 32. To engage the LO filler material 32, the planing tool 12 may be directed in a desired cut direction such that the pair of leading rollers 48 and the pair of mid rollers 52 roll with their axes 49, 53 oriented perpendicular to the cut direction and straddle the LO filler material 32 while the cutter 16 is moved to engage the proud-standing LO filler material 32. The planing tool 12 may also be directed such that the elongated aft roller 46 rolls behind the cutter 16 with the axis of the aft roller 46 oriented perpendicular to the cut direction and parallel to the orientation contact plane 28.

A contoured surface planing apparatus constructed as described above allows excess LO filler paste to be quickly removed from fastener holes in composite aircraft skin panels with minimum manual effort, and without danger of causing damage to the aircraft skin. The device may remove enough excess LO filler so that an outer surface of the remaining LO filler lies nearly flush (0.002-0.005" proud, depending on contour curvature) with an outer surface of the skin panel. Use of a setup fixture such as the described zero-setter allows the tool to be accurately configured for each use, even in cases where extended use has worn down the cutter surface.

This description, rather than describing limitations of an invention, only illustrates an embodiment of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A contoured surface planing apparatus comprising a tool including:

a main body;

a rotary cutter supported by the main body for rotation about a cutter axis and comprising an abrasive outer circumferential cutter surface;

a motor operatively engageable with the cutter and configured to drive the cutter in rotation about the cutter axis;

at least three rollers supported on the base and having rolling contact points spaced around the cutter and defining rolling contact plane disposed parallel to the cutter axis, at least two of the rollers being leading rollers disposed forward of the cutter, and one of the rollers being an aft roller disposed aft of and in alignment with the cutter relative to an intended direction of cut.

2. A contoured surface planing apparatus as defined in claim 1 in which the rollers are wheels supported on the base for rotation about respective roller axes disposed parallel to the cutter axis and normal to an intended direction of cut.

3. A contoured surface planing apparatus as defined in claim 1 in which the tool includes a rolling foot comprising the rollers and a chassis carried by the main body and upon which the rollers are supported for rotation, the position of the rolling foot being supported on the main body for reciprocal motion relative to the main body between fully extended and fully retracted positions to adjust cutter displacement.

4. A contoured surface planing apparatus as defined in claim 3 in which the tool includes a cutter displacement adjustment screw threadedly engaged with the main body and bearing downward against the chassis, and the tool further includes a biasing element supported between the chassis and the main body in a position to bias the rolling foot upward against the adjustment screw.

5. A contoured surface planing apparatus as defined in claim 1 in which the aft roller comprises an elongated rolling element supported on the base for rotation about an aft roller axis oriented parallel to the rolling contact plane and spaced behind the cutter relative to the intended direction of cut.

6. A contoured surface planing apparatus as defined in claim 4 in which the aft roller axis is oriented parallel to the cutter axis.

7. A contoured surface planing apparatus as defined in claim 1 in which the aft roller spans an axial length greater than or equal to an axial length of the outer circumferential cutter surface.

8. A contoured surface planing apparatus as defined in claim 7 in which the axial length of the aft roller is as at least as long as an axial length of the outer circumferential cutter surface.

9. A contoured surface planing apparatus as defined in claim 1 in which two of the rollers are side mid rollers supported on the base for rotation about respective mid roller axes, the roller axes being parallel to the cutter axis and disposed between the cutter axis and the rotary abrasion contact region of the rotary cutter.

10. A contoured surface planing apparatus comprising a tool including:

a main body;

a rotary cutter supported by the main body for rotation about a cutter axis and comprising an abrasive outer circumferential cutter surface;

a motor operatively engageable with the cutter and configured to drive the cutter in rotation about the cutter axis;

at least three orientation contact points spaced around the cutter and defining an orientation contact plane disposed parallel to the cutter axis;

the apparatus further including a setup fixture comprising:

a support surface;

a cutter contact element biased upward relative to the support surface; and a gage connected to the cutter contact element and configured to measure cutter displacement by measuring cutter contact element displacement relative to the support surface and to display a visual representation of the magnitude of cutter displacement when the tool is resting on the support surface.

11. A contoured surface planing apparatus as defined in claim 10 in which one of the tool and setup fixture includes a guide pin and the other of the tool and setup fixture includes a guide pin receptacle positioned and configured to receive the guide pin when the tool is mounted on the setup fixture.

12. A contoured surface planing apparatus as defined in claim 11 in which the setup fixture includes two parallel guide pins extending from spaced apart locations on the support surface, and the tool includes two parallel guide pin receptacles positioned to receive the guide pins when the tool is placed on the setup fixture.

13. A method for removing proud-standing material from a contoured surface without damaging the surface, the method including the steps of:

adjusting to a desired cutter displacement value the distance between an orientation contact plane and a rotary abrasion contact region of a surface planing tool, by mounting the tool on a support surface of a setup fixture such that orientation contact points of the tool are resting on a support surface of the fixture, a rotary cutter of the tool is resting on a cutter contact element of the fixture, and a gage connected to the cutter contact element is displaying a numerical value representing the distance between the rotary abrasion contact region and the orientation contact plane of the tool;

positioning the planing tool on a working surface with orientation contact points of the tool resting on the working surface;

reducing the height of proud-standing material on the working surface by directing the tool along the working surface while maintaining the orientation contact points of the tool in contact with the working surface and while engaging the cutter with the proud-standing material.

14. The method of claim 13 in which the adjusting step includes adjusting cutter displacement until the gage is displaying a desired cutter displacement value.

15. The method of claim 13 in which:

the tool includes a pair of leading rollers supported for rotation about respective axes and defining two of the orientation contact points of the tool; and the reducing step includes directing the planing tool in a desired cut direction with axes of the leading rollers oriented perpendicular to the cut direction and with the leading rollers straddling the proud-standing material as the cutter engages the proud-standing material.

16. The method of claim 15 in which:

the tool includes an aft roller supported on the tool chassis for rotation about an aft roller axis and defining another of the orientation contact points of the tool; and the reducing step includes directing the planing tool such that the aft roller rolls trailing the cutter with the cutter and aft roller axes oriented perpendicular to the desired cut direction and parallel to the orientation contact plane.

* * * * *